United States Patent [19]

Roca Nierga

[11] Patent Number: 4,535,745

[45] Date of Patent: Aug. 20, 1985

[54] ADVANCE VARIATOR FOR A FUEL INJECTION PUMP

[75] Inventor: Manuel Roca Nierga, Leghorn, Italy

[73] Assignee: SPICA S.p.A., Italy

[21] Appl. No.: 579,978

[22] Filed: Feb. 14, 1984

[30] Foreign Application Priority Data

May 2, 1983 [IT] Italy ..... 20879 A/83

[51] Int. Cl.[3] ..... F02M 59/20

[52] U.S. Cl. ..... 123/502

[58] Field of Search ..... 123/502, 501, 179 G; 417/462

[56] References Cited

U.S. PATENT DOCUMENTS

| | | | |
|---|---|---|---|
| 4,224,916 | 9/1980 | Davis | 123/502 |
| 4,294,218 | 10/1981 | King et al. | 123/502 |
| 4,345,566 | 8/1982 | Hammock | 123/502 |
| 4,355,621 | 10/1982 | Yasuhara | 123/502 |
| 4,384,562 | 5/1983 | Hammock | 123/502 |
| 4,408,591 | 10/1983 | Nakamura | 123/502 |
| 4,457,284 | 7/1984 | Salzgeber | 123/502 |

FOREIGN PATENT DOCUMENTS

| | | | |
|---|---|---|---|
| 2455680 | 11/1980 | France . | |
| 73828 | 5/1982 | Japan | 123/502 |
| 8200857 | 3/1982 | PCT Int'l Appl. . | |

*Primary Examiner*—Magdalen Y. C. Moy

*Attorney, Agent, or Firm*—Diller, Ramik & Wight

[57] ABSTRACT

The invention relates to an improvement in internal combustion engine injection pump, according to which the injection timing is modified by moving the timing element (9) by means of a hydraulic actuator (41) fed with fuel which varies in pressure with the pump speed and which urges the actuator piston (42) against elastic means which react within an axially mobile rotating cylinder (47), of which the axial position is determined by contact between two cam surfaces (52,56) in series, and of which the rotation is a function of the position of the pump throughput control members.

23 Claims, 3 Drawing Figures

ADVANCE VARIATOR FOR A FUEL INJECTION PUMP

This invention relates to a device for controlling and varying the advance of an injection pump, particularly of the distributor type, for internal combustion engines operating on the diesel cycle. Conventional distributor injection pumps characteristically comprise a cam and roller system for impressing a movement which, in phase with the engine rotation, results in the pumping of the fuel and its distribution to the various engine cylinders, and further comprise means for regulating and controlling the fuel quantity delivered by the injection pump, a low pressure pump for feeding fuel to the injection pump, valve means for controlling the delivery pressure of the feed pump such as to cause said pressure to increase as the rotational speed of the injection pump increases, and a hydraulic piston device which, subjected to the pressure of the feed pump, moves in opposition to elastic means in order to impress on the cam system a movement for varying the timing of the commencement of injection.

This hydraulic variation device, of which the technology is well known, automatically advances the injection timing as the rotational speed of the internal combustion engine with which the pump is associated increases.

Current engine requirements relative to maximum noise limitation, improvement in fuel consumption, limitation of residual toxic gas deriving from combustion, and the need to facilitate engine starting particularly under cold conditions, are however unsatisfied by an advance variation method which takes account only of the engine rotational speed.

For this reason, various methods have appeared in recent years which although maintaining the hydraulic piston system also modify the injection timing in accordance with the braking load applied to the engine, and with the engine operating temperature, or alternatively which take account of particular operating situations (starting). The methods used for solving the problem embrace a wide range of devices ranging from the use of auxiliary hydraulic pistons to the use of servo-controlled systems, and including manual or automatic lever mechanisms and two or three-position contact cams. Other systems are also known which alter the hydraulic pressure acting on the operating piston of the advance variator by uncovering certain holes of predetermined size placed in parallel with fuel feed circuit.

Independently of the greater or lesser complexity of these devices, it can be seen that the characteristic common to each of them is the poor operational flexibility and the practical impossibility of being able to follow any predetermined law which governs the variation in the advance as a function of the auxiliary parameters. The seriousness of these limitations is immediately apparent when considering the requirement to vary the advance as a function of said various parameters not only in terms of value but also in terms of sign, according to the combustion system used on the diesel engine concerned. For example, at the moment of starting, some engines require the injection timing to be retarded relative to that used during normal operation, whereas other engines require timing to be advanced on starting.

Most of the known devices do not allow changing the sign of their action on the timing as a function of the auxiliary parameters, and those that do allow it are able to perform only part of the functions currently required.

A recent method, illustrated in French patent No. 2,471,481, in practice enables the required action to be taken on the injection timing according to the engine operating conditions, but requires complicated and bulky devices external to the injection pump in order to variously combine the inferences determined by the various operational parameters considered. The signal resulting from the mixing of the individual signals relating to the various parameters is then applied to the pump advance device.

However, in addition to the stated problems of complexity and size, such a system has the drawback of being difficult to modify operationally after it has been fitted between the pump and engine. The object of the present invention is therefore to provide a device for varying the advance of an injection pump, particularly of the distributor type, which is of simple and convenient form and can perform the following functions:

(a) automatically advance the commencement of injection as the rotational speed of the engine with which the pump is associated increases, (b) automatically satisfy any law governing the timing variation, either in the sense of advancing or retarding it, as a function of the braking load applied to the engine, (c) automatically following any law governing the timing, either in the sense of advancing or retarding it, as a function of the engine operating temperature, (d) automatically or manually varying the timing, either in the sense of advancing or retarding it, on starting the engine, (e) absolute independence of the aforesaid functions, (f) easy replacement, even with the pump mounted, of the control elements which determine the operational behaviour of the advance device, (g) allowing the device for mixing the various influences determined by the variation in the considered engine parameters to be completely contained within the injection pump.

This object is attained according to the invention by a fuel injection pump for an internal combustion engine, of the type comprising a cam mechanism, of which the rotating part rotates synchronously with said engine and the semi-fixed part can be moved by a hydraulic device in order to vary the injection timing of said pump, said hydraulic device comprising a piston slidable relative to the pump casing and subjected to a fuel pressure which varies with the speed of said pump, in order to move, in opposition to elastic means, the semi-fixed part of the mechanical cam device to which it is connected by connection means, the pump being characterised in the said slidable piston and said elastic opposition means are contained in a housing which is free to move relative to said pump casing and has one of its end faces exposed to said fuel pressure so that it rests, under the thrust of the axial resultant of the pressure acting on the surface of said piston and of said housing, against a first profiled surface of a double cam element disposed at that end of the housing which is not subjected to said pressure which varies with the rotational speed of said pump, and said housing comprising means for its connection to the element which controls the injection pump throughput in order to effect a rotary movement proportional to the movement of said element and thus modify its axial position as a function of said rotary movement and of the pattern of the first surface of said double cam element against which it rests, said double cam element also comprising a second profiled surface opposite to said first surface on which said housing rests, and acting against a mobile abutment which is connected to control means in order to undergo an axial movement as a function of the pattern of said second profiled surface and of the movement of said mobile abutment, and to thus impress an analogous movement on said housing, on the piston contained in it, and on the connection means to the semi-fixed part of the cam mechanism, in order to determine a corresponding variation in the timing of the commencement of the injection pump delivery.

One embodiment of the device according to the invention is described hereinafter by way of non-limiting example with reference to the accompanying figures, in which.

Figure 1:
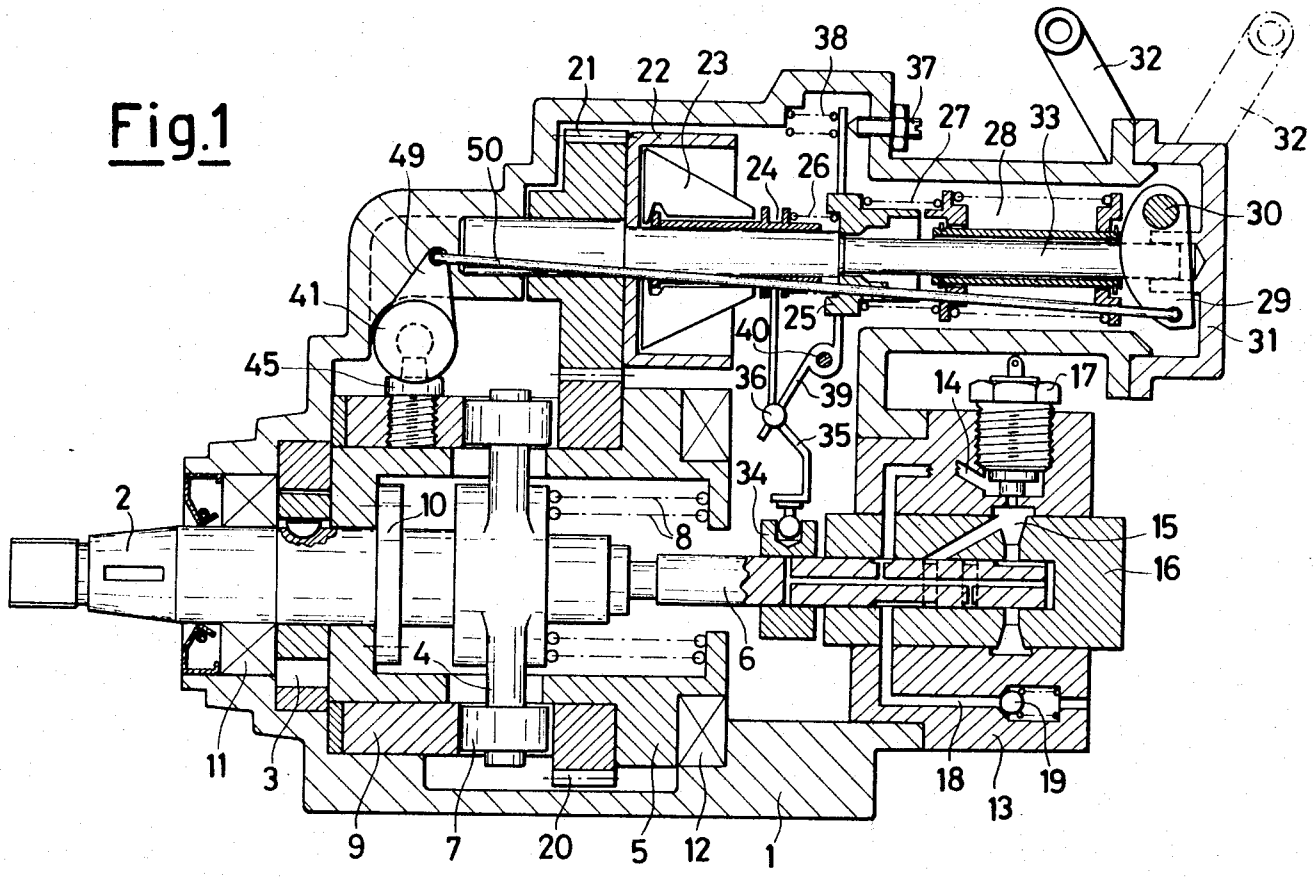
FIG. 1 is a diagrammatic section through an injection pump of the distributor type comprising the advance variation device according to the invention.

With reference to FIG. 1, the casing 1 of a distributor injection pump contains a control shaft 2 which is connected to the internal combustion engine and rotates the feed pump 3 of the injection pump, the roller support spider 4, the spring container cup 5 and the piston 6 of the pumping element. The spider 4, fitted with rollers 7, is pressed against the lobe ring 9 by the springs 8 reacting against the cup 5, so that during its rotation in phase with the shaft 2 it assumes a reciprocating axial movement which is transmitted to the piston 6 to effect the fuel intake and pumping stages. The rotating control unit, which is made rigid by the connection between the flange 10 of the shaft 2 and the base of the cup 5, is supported by the support bearings 11 and 12, which, being located at the two ends of the said unit, obviate cantilever operation.

The hydraulic head 13 of the injection pump comprises the duct 14 which is connected to the pump 3 to feed the feed channels 15 of the cylinder 16 at a pressure which increases as the engine rotational speed increases. A shut-off electromagnet 17 interrupts the connection between the ducts 14 and 15 if stoppage of the engine is necessary.

As the piston 6 rotates, the distribution channels present on it alternately connect the pressure chamber of the pumping element to the delivery ducts 18, each of which is associated with a valve 19 and an injector unit, not shown. The device for controlling and regulating the injection pump throughput is housed in the top of the pump casing 1, parallel to the already described pump control unit. This device is driven by the drive gear 20 rigid with the pump control unit, and comprises the driven gear 21, the cage 22 housing the centrifugal masses 23, the thrust tube 24, the intermediate cup 25, the supplement and idling springs 26 and 27, and a reaction unit 28 formed from one or more compression springs in series or in parallel which are mounted, together with two end cups cooperating with split retaining rings, on a central support tube.

The load applied by the reaction unit 28 to the intermediate cup 25 depends on the position of the eccentric 29, which is rigid with the spindle 30 supported in the cover 31 and moves in such a manner as to satisfy the same law as the control lever 32 connected to the internal combustion engine accelerator device.

The end cover 31 also supports the regulator spindle 33 and allows easy access to the compartment containing the reaction unit 28, to permit rapid replacement thereof.

The regulator device controls the quantity of fuel injected for each stroke of the piston 6 by axially moving the regulator ring 34, which determines the instant of termination of the injection by uncovering the transverse bores present in said piston.

The regulator unit is connected to the control ring 34 by the transmission lever 35 which is pivoted on the mobile pin 36 and follows the movement of the thrust tube 24.

The maximum throughput is adjusted by adjusting the stop screw 37 on which there rests, under the thrust of the spring 38, the adjustment lever 39 which is pivoted on the fixed pin 40 and carries at its other end the mobile pin 36. If the adjustment screw 37 is replaced by an abutment which moves as a function of the engine operating parameters (supercharging pressure, r.p.m.), a curve representing the variation in the maximum injection pump throughput as said parameters vary can be obtained.

The interior of the pump casing 1 is completely filled with fuel which, being maintained (by means of a valve, not shown) at a pressure considerably lower than the feed pressure of the pumping element, lubricates all the mechanical units contained in said pump casing. The hydraulic advance variator 41 constructed in accordance with the invention is disposed transversely above the injection pump control unit. Said variator comprises (see also FIG. 2) an actuator piston 42 subjected at one end to the pressure of the fuel contained in the chamber 43 in order to move the spherical pin 45, rigid with the lobe ring 9, against the reaction of the main spring 44. The piston 42 and the reaction unit, formed by the spring 44 and thrust disc 46, are contained in a cylindrical housing 47 free to move in the corresponding cylindrical seat 48 provided in the injection pump casing 1. The housing 47 is also provided with an appendix 49 which is connected by the tie rod 50 to the eccentric 29 (FIG. 1) which defines the loading of the spring unit 28 as a function of the position of the external control lever 32.

The housing 47 reacts to the hydraulic thrust by forcing its contact pin 51 against a first profiled surface 52 of a double cam element 53 which is free to move axially within the cylindrical seat 48 but is prevented from rotating by the pin 54 which is rigid with the injection pump body 1 and is housed in the longitudinal slot 55 of the double cam element 53. Said element 53 rests by way of its second profiled surface 56 on the thrust pin 57, which is rigid with a rotor 58 supported by the fixed bush 59 and connected to the external operating lever 60.

The start retarding spring 61 detaches the pin 51 from its contact with the cam surface 52 when the engine is at rest and pressure is therefore absent in the chamber 43, and axially moves the housing 47 until it makes contact with the internal abutment 65 of the closure cover 62 of the chamber 43.

According to the functions performed, the hydraulic advance variator can comprise certain modifications (FIG. 3) in which the contact spring 63 is contained in the pressure chamber 43, and the mobile bush 59' is rotated by the lever 64 in order to also provide the cam element 53 with rotary motion.

The end-of-stroke stop surfaces at the retardation end between the piston 42 and housing 47 can assume various forms according to the required pressure differential between the separation and re-contacting of these two parts. For example, the form adopted in FIG. 3 provides a much greater differential than that of the example of FIG. 2, because of the greater difference between the piston areas exposed to the pressure under the two respective operating conditions.

The operation of the device is as follows:

The main advance variation is effected as a function of the speed of rotation of the pump, and is performed in known manner by the piston 42, on which the pressure of the fluid contained in the chamber 43 acts. This pressure, which is usually but not always the same as that at which the transfer pump 3 feeds the pumping element, increases as the rotational speed of the injection pump increases, and causes the piston 42 to move by overcoming the opposing reaction of the main spring 44. During its movement, said piston forces the lobe ring 9, to which it is connected by means of the pin 45, to rotate about its axis and thus vary the timing of commencement of delivery. Because of the hydraulic requirements of the injection system and the thermodynamic requirements of the internal combustion engine, said timing varies in the sense of advancing the commencement of delivery as the rotational speed increases.

Advance variation as a function of the braking load applied to the engine, and thus as a function of the quantity delivered per stroke of the injection pump, is attained by connecting the appendix 49, provided on the housing 47 containing the operating piston 42, to the cam eccentric 29 which loads the spring block 28. In this respect, the position of said eccentric, which is determined by the external control lever 32 connected to the engine accelerator device, defines the throughput of the injection pump for a certain type of regulator usually used in the automobile field. The connection between the eccentric 29 and the appendix 49, by means of the tie rod 50, thus induces a rotation of the housing 47 as a function of the pump delivery, and consequently as a function of the load applied to the engine.

Said housing 47 reacts to the hydraulic thrust acting on the piston 42 by resting its pin 51 against the first profiled surface of the cam 53, and thus when it rotates, the housing assumes an axial movement which is a function of its angle of rotation and of the pattern of the surface 52 of the cam element. The piston 42 follows the housing in its movement, and impresses on the lobe ring 9 the required positional correction as a function of the engine loading.

Alternatively, information regarding the quantity delivered by each stroke of the injection pump can be obtained by connecting the appendix 49 of the housing 47 to the transmission lever 35, which joins the thrust tube 24 of the regulator to the control ring 34 mounted slidably on the pump piston 6.

The further correction of the advance as a function of the engine temperature, which is especially important particularly under idling conditions, is attained according to the invention by allowing the cam element 53 to move axially and providing said element with a second profiled surface 56 which rests against a second pin 57 mounted eccentrically on the hub 58 of a control lever 60. The double cam element is prevented from rotating by the pin 54 which is rigid with the pump casing 1 and with the fixed bush 59, but allows it to move axially by cooperating with the slot 55. It is apparent that on operating the control lever, the double cam element 53 and the entire mobile assembly situated between said element and the pressure chamber 43 undergo an axial movement as a function of the angle of rotation of the lever 60 and of the pattern of the second profiled surface 56. By connecting the control lever 60 to an actuator which causes it to move proportionally to the engine temperature, the required timing variation as a function of this parameter is thus obtained.

The law governing the variation in the position of the lobe ring, and thus the commencement of injection pump delivery, is consequently determined by the resultant of the individual variations which become superposed on each other as a function of the three considered operating parameters (r.p.m., throughput, temperature).

Figure 2:
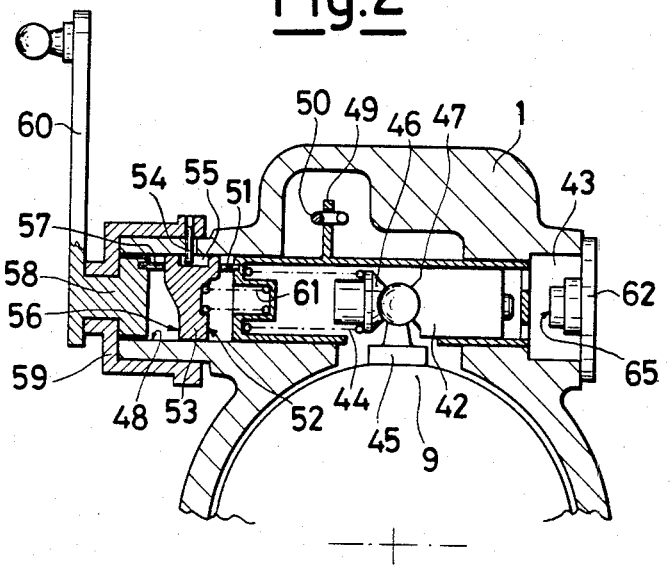
FIG. 2 shows an embodiment of the advance variator with constant retardation of the start.
Figure 3:
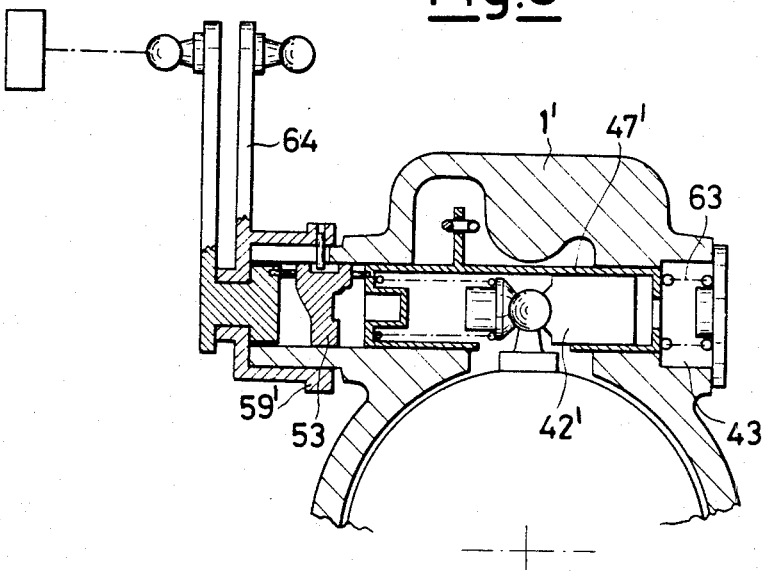
FIG. 3 is a version of the advance variator which is able to provide any start timing variation, either in the sense of advancing or retarding it, and to modify this variation as a function of the engine operating conditions.

FIG. 2 also shows the start retarding spring 61 which when the pump is at rest, and thus pressure in the chamber 43 is absent, detaches the housing 47 from its contact with the surface 52 of the double cam element 53 in order to cause its other end to abut against the surface 65 of the closure cover 62.

It should be noted that the term "double cam element" 53 generally signifies a device provided with two cam surfaces in series, which in the embodiment heretofore described are formed on the same element 53. However, the said device can assume different constructional forms, in particular by forming the cam surfaces and the relative follower on different elements. For example, in the embodiment of FIG. 2, the surface 56 can be formed on the member 58 and the follower 57 can be mounted on the element 53.

In the case considered, the retardation necessary to facilitate starting is defined when making the initial setting, and in practice is not influenced either by the position of the control lever of the regulator 32 or by the position of the lever 60 connected to the element which senses the engine operating temperature.

For the particular fuel system used, if it is required instead to obtain start advance, or, during this stage of the operation, any variation (in the sense of advancement or retardation) but of a value which varies with a functional parameter, for example the engine temperature, the invention uses an arrangement such as that shown diagrammatically in FIG. 3.

The spring providing advance variation during the starting stage is in this case disposed directly inside the chamber 43, and ensures contact between the pin 51 of the housing 47' and the surface 52 of the double cam element 53 even when the fluid contained in said chamber is not under pressure. Contact between the profiled surface 56 and the cooperating pin 57 rigid with the hub 58 is likewise ensured.

The valve elements disposed in known manner in the fuel feed and discharge ducts to the chamber 43 enable the liquid contained in this latter to provide a suitable opposing reaction, even during engine starting, to the resultant acting along the variator axis and deriving from the pumping torque originating from the lobe ring 9. The required variation in the start advance is obtained by manually or automatically operating the auxiliary lever 64 during starting, to thus cause the thrust pins 51 and 57 to collaborate with a profiled surface portion of the double cam element which is usually not contacted during normal engine operation. The sense of the timing variation (advance or retardation) is determined by the pattern of the cam surfaces.

If profiled surfaces of continuous type are provided, and the operating angle of the auxiliary lever 64 varies as a function of any parameter, for example the engine temperature, a variation in the start advance is obtained as a function of the parameter considered. If the engine is hot, and if required, it would thus be possible to start without any variation, or indeed to effect a variation which is in the reverse direction to that for cold starting.

As the auxiliary lever 64 cannot be operated after the engine has started, the operation of the hydraulic variator shown in FIG. 3 is similar to that of FIG. 2 during normal use.

The start advance can have a variability similar to that heretofore described even with the device of FIG. 2, provided the spring 63 is used inside the pressure chamber 43 instead of the represented spring 61, and the lever 60 is given two different operating sectors, the first of which being to obtain the required timing on starting and the second to effect timing variation as a function of the engine temperature when the engine is running.

It should however be noted that, although more simple, this version has less freedom than the double lever version because the start advance is also influenced by the position of the control lever of the regulator 32, which is connected by the eccentric 29 and tie rod 50 to the appendix 49 of the housing 47. In the case of the double lever regulator, because of the rotation of the double cam element 53 this position can be made to exert no influence by providing a flat sector on the surface 52.

Finally, it should be noted that the operational characteristics of the device according to the invention can be very easily modified by rapid replacement of the double cam element from the outside.

I claim:

1. A fuel injection pump for an internal combustion engine comprising a pump casing (1), means (6, 13-15, 23-35, etc.) for effecting and controlling the fuel throughput of said fuel injection pump, means (9) relatively arcuately adjustable in said pump casing (1) for varying the injection timing of said fuel injection pump, hydraulic actuator means (41) for arcuately adjusting said injection timing varying means (9), said hydraulic actuator means (41) includes a reciprocal piston (42) having first and second opposite end portions opposingly biased by fuel pressure and biasing means (44), respectively; means (45) operatively coupled between said injection timing varying means (9) and said reciprocal piston (42) for arcuately adjusting said injection timing varying means (9) in response to movement of said reciprocal piston (42), a housing (47) within and movable relative to said pump casing (1) housing said reciprocal piston (42), said housing (47) having opposite first and second end portions, said housing second end portion being exposed to fuel pressure in said pump casing (1), a double cam element (53) having first and second cam surfaces (56 and 52, respectively), said double cam element (53) being positioned with said second cam surface (52) adjacent said housing second end portion whereby said housing second end portion is urged into operative relationship with said second cam surface (52) under the resultant pressure of the fuel pressure acting upon said reciprocal piston (42) and said housing second end portion; means (49, 50) for connecting said housing (47) to said fuel throughput effecting and controlling means (6, 13-15, 23-35, etc.) whereby selective movement of said fuel throughput effecting and controlling means (6, 13-15, 23-35, etc.) effects rotary movement of said housing (47) and the position of its operative relationship with said second cam surface (52), and means (57, 60, 64) operative through said first cam surface (56) for shifting said double cam element (53) relative to said housing second end portion thereby shifting said housing (47), said piston (42) and said injection timing varying means (9) through said coupling means (45) to effect a variation in the timing of the commencement of injection pump fuel delivery.

2. The fuel injection pump as defined in claim 1 including means (61) for normally biasing said housing (47) away from said double cam element (53).

3. The fuel injection pump as defined in claim 1 including abutment means (65) outside said housing (47) adjacent said housing first end portion, and means (61) for normally biasing said housing (47) away from said double cam element (53) toward a position at which said housing first end portion abuts said abutment means (65).

4. The fuel injection pump as defined in claim 1 including means (63) for biasing said second housing end portion into operative relationship with said second cam surface (52) of said double cam element (53).

5. The fuel injection pump as defined in claim 1 wherein said fuel effecting and controlling means (6, 13-15, 23-35, etc.) includes a fuel regulator (23-30) having an elastic reaction unit (28), an eccentric (29) for operating said elastic reaction unit (28), and said connecting means (49, 50) is disposed between said housing (47) and said eccentric (29).

6. The fuel injection pump as defined in claim 1 wherein said fuel effecting and controlling means (6, 13-15, 23-35, etc.) includes a fuel regulator (23-30) having an elastic reaction unit (28) and an aligned thrust tube (24), a piston (6) and a control ring (34) reciprocal on said piston (6); and said fuel effecting and controlling means (6, 13-15, 23-35, etc.) further includes a transmission lever (35) connected between said control ring (34) and said thrust tube (24).

7. The fuel injection pump as defined in claim 1 wherein said biasing means (44) is a compression spring.

8. The fuel injection pump as defined in claim 1 including means (61) for normally biasing said housing (47) away from said double cam element (53), and said last-mentioned biasing means (61) is a compression spring.

9. The fuel injection pump as defined in claim 1 including means (63) for biasing said housing second end portion into operative relationship with said second cam surface (52) of said double cam element (53), and said last-mentioned biasing means (63) is a compression spring.

10. The fuel injection pump as defined in claim 1 including means (61) for normally biasing said housing (47) away from said double cam element (53), means (63) for biasing said housing second end portion into operative relationship with said second cam surface (52) of said double cam element (53), and said last two-mentioned biasing means (61, 63) are each a compression spring.

11. The fuel injection pump as defined in claim 1 including means responsive to engine temperature for operating said shifting means (57, 60, 64).

12. The fuel injection pump as defined in claim 1 including means (51, 54) for preventing rotation of said double cam element (53).

13. The fuel injection pump as defined in claim 1 wherein said shifting means (57, 60, 64) includes an operable element (64) nonrotatably connected to said double cam element (53) and means responsive to engine temperature for operating said operable element (64).

14. The fuel injection pump as defined in claim 1 wherein said first cam surface (56) of said double cam element (53) includes two different cam surface portions selectively operative with said shifting means (57, 60, 64) depending upon whether an associated engine is in its starting stage or in its normal operating stage.

15. The fuel injection pump as defined in claim 2 including abutment means (65) outside said housing (47) adjacent said housing first end portion, and means (61) for normally biasing said housing (47) away from said double cam element (53) toward a position at which said housing first end portion abuts said abutment means (65).

16. The fuel injection pump as defined in claim 2 including means (63) for biasing said second housing end portion into operative relationship with said second cam surface (52) of said double cam element (53).

17. The fuel injection pump as defined in claim 2 wherein said fuel effecting and controlling means (6, 13-15, 23-35, etc.) includes a fuel regulator (23-30) having an elastic reaction unit (28), an eccentric (29) for operating said elastic reaction unit (28), and said connecting means (49, 50) is disposed between said housing (47) and said eccentric (29).

18. The fuel injection pump as defined in claim 2 wherein said fuel effecting and controlling means (6, 13-15, 23-35, etc.) includes a fuel regulator (23-30) having an elastic reaction unit (28) and an aligned thrust tube (24), a piston (6) and a control ring (34) reciprocal on said piston (6); and said fuel effecting and controlling means (6, 13-15, 23-35, etc.) further includes a transmission lever (35) connected between said control ring (34) and said thrust tube (24).

19. The fuel injection pump as defined in claim 3 including means (63) for biasing said second housing end portion into operative relationship with said second cam surface (52) of said double cam element (53).

20. The fuel injection pump as defined in claim 3 wherein said fuel effecting and controlling means (6, 13-15, 23-35, etc.) includes a fuel regulator (23-30) having an elastic reaction unit (28), an eccentric (29) for operating said elastic reaction unit (28), and said connecting means (49, 50) is disposed between said housing (47) and said eccentric (29).

21. The fuel injection pump as defined in claim 3 wherein said fuel effecting and controlling means (6, 13-15, 23-35, etc.) includes a fuel regulator (23-30) having an elastic reaction unit (28) and an aligned thrust tube (24), a piston (6) and a control ring (34) reciprocal on said piston (6); and said fuel effecting and controlling means (6, 13-15, 23-35, etc.) further includes a transmission lever (35) connected between said control ring (34) and said thrust tube (24).

22. The fuel injection pump as defined in claim 4 wherein said fuel effecting and controlling means (6, 13-15, 23-35, etc.) includes a fuel regulator (23-30) having an elastic reaction unit (28), an eccentric (29) for operating said elastic reaction unit (28), and said connecting means (49, 50) is disposed between said housing (47) and said eccentric (29).

23. The fuel injection pump as defined in claim 4 wherein said fuel effecting and controlling means (6, 13-15, 23-35, etc.) includes a fuel regulator (23-30) having an elastic reaction unit (28) and an aligned thrust tube (24), a piston (6) and a control ring (34) reciprocal on said piston (6); and said fuel effecting and controlling means (6, 13-15, 23-35, etc.) further includes a transmission lever (35) connected between said control ring (34) and said thrust tube (24).

* * * * *